United States Patent [19]

Forde

[11] Patent Number: 4,798,219

[45] Date of Patent: Jan. 17, 1989

[54] UMBRELLA PACKAGE

[76] Inventor: Liam Forde, Sungib Industrial Building, 20th Floor, Flats 3 & 4, 53 Wong Chuk Hang Road, Aberdeen, Hong Kong

[21] Appl. No.: 801,575

[22] Filed: Oct. 16, 1986

[51] Int. Cl.[4] ..... A45B 3/00; A45B 25/18; B65D 65/00; A47F 13/06

[52] U.S. Cl. ..... 135/16; 135/33 C; 294/19.2; 206/497

[58] Field of Search ..... 135/33 C, 16, 25 R, 135/17, 18, 19, 19.5; 294/19.2; 206/497

[56] References Cited

U.S. PATENT DOCUMENTS

| | | | |
|---|---|---|---|
| 1,885,968 | 11/1932 | Wedemann | 135/33 C |
| 1,937,828 | 12/1933 | MacDonald | 294/19.2 |
| 3,227,867 | 1/1966 | Baker | 135/16 X |
| 3,245,421 | 4/1966 | Braun et al. | 135/16 |
| 3,698,720 | 10/1972 | Gudmundsen | 294/19.2 X |
| 3,744,502 | 7/1973 | Weber | 135/33 C X |
| 3,935,874 | 2/1976 | Cohen | 135/33 C X |
| 4,045,068 | 8/1977 | Nelson | 294/19.2 |
| 4,058,336 | 11/1977 | Parkinson | 294/19.2 |
| 4,088,251 | 5/1978 | Rodriguez | 294/19.2 X |
| 4,368,749 | 1/1983 | Lindler et al. | 135/20 R |
| 4,516,267 | 5/1985 | Kent et al. | 206/497 X |
| 4,522,438 | 1/1985 | Logue | 294/19.2 |
| 4,624,275 | 11/1986 | Baldwin | 135/19.5 |
| 4,733,681 | 3/1988 | Lee | 135/16 |

FOREIGN PATENT DOCUMENTS

| | | | |
|---|---|---|---|
| 687608 | 4/1930 | France | 135/33 C |
| 682885 | 11/1952 | United Kingdom | 294/19.2 |
| 682899 | 11/1952 | United Kingdom | 294/19.2 |
| 538894 | 4/1957 | United Kingdom | 294/19.2 |

OTHER PUBLICATIONS

Sales Sheet from Haas-Jordan re: "Putter's Pick-Up".

*Primary Examiner*—Robert A. Hafer
*Assistant Examiner*—D. Neal Muir
*Attorney, Agent, or Firm*—Allegretti & Witcoff, Ltd.

[57] ABSTRACT

An umbrella package is disclosed in which the umbrella is housed in a golf ball pick-up tube. A golf ball pick-up device may be already installed on the end of the tube, or housed therein as a separate component. The pick-up device is essentially a cylindrical element with an inwardly extending lip thereon past which a golf ball may be forced on its way into the tube. The umbrella in collapsed form is held within the tube by one or more end caps or pieces, sometimes in combination with a golf ball pick-up device, and even with the golf ball being part of the retaining mechanism.

17 Claims, 1 Drawing Sheet

UMBRELLA PACKAGE

BACKGROUND TO AND SUMMARY OF THE INVENTION

This invention relates to the packaging of umbrellas, and particularly seeks to provide in such a package useful equipment which minimizes the need for disposable packaging material. It relates especially to the packaging of golfing umbrellas.

According to the present invention an umbrella is packed in a tube which is adaptable to serve the alternative function of a golf ball pick-up tube. Such packaging has a number of advantages. The tube provides good protection for the umbrella contained within it. The package may also be easily sent through the public mail service with minimal need for further protection or wrapping. In some cases, the package may be manufactured and assembled ready for despatch through the mail to a customer with only the attachment of a label with details of the addressee being required. It will be appreciated then, that packages according to the invention eminently suitable for adoption by mail order sales companies. Indeed, suitable liasion between a mail order company and a manufacturer can provide even for the name and address of a customer to be made visible on the package at the manufacturing stage.

The golf ball pick-up tube in the package of the invention is typically formed in a plastics material and, when adapted to its pick-up function will have a ball pick-up device mounted at one end. The pick-up device is manufactured of a cylindrical element extending coaxially from the tube, with an annular resilient lip extending inwardly to a radius less than that of the tube. This arrangement enables a golf ball to be forced past the lip into the end of the tube, and retained therein behind the lip. Forcing an additional ball past the lip merely carries the earlier ball or balls further into the tube. The other end of the tube may be closed by a cap.

When the tube is housing an umbrella in collapsed form, the golf ball pick-up device and end cap just mentioned may, either or both, be in their pick-up tube functional positions. In some cases however, separate removable end pieces are used to package the umbrella, which pieces are discarded by the customer. In these cases, either or both of the pick-up device and end cap can be housed within the tube around respective ends of the umbrella.

Where the pick-up device and/or the end cap remains on the tube in the package some separate means is provided to prevent the umbrella from leaving the tube through the pick-up device, which may be an integral part of the tube. In one embodiment of the invention, such means may be a golf ball retained behind the lip of the pick-up device and abutting against an end, normally the handle, of the umbrella.

Packages of the invention are normally enclosed in a removable sleeve which a customer will eventually discard. Typically the sleeve is shrink fitted around the tube end whatever end closure mechanism is used. The sleeve may be printed in any number of ways to identify for example, the manufacturer and/or selling organizations, and as noted above, in some cases customer details may also be given.

It is preferred that only plastics material are used predominantly in the manufacture of the components to packages according to the invention, and particularly with respect to the umbrella, reference is directed to British Patent Application No. 8424089, the disclosure of which is incorporated herein by reference. The tube is normally transparent, and the sleeve may be at least partially transparent also if either the umbrella or some labelling within the tube but around the umbrella is intended to be visible. Normally though, the sleeve will be opaque. The pick-up device is usually moulded in a rubber compound, and can commonly be natural rubber. An end cap if used can also be formed in a soft material although the disposable end pieces will preferably be substantially rigid.

BRIEF DESCRIPTION OF THE DRAWINGS

The invention may be embodied in a number of ways of which two examples are illustrated in the accompanying drawings wherein the same reference numerals are used to identify like components. In the drawings.

DESCRIPTION OF THE PREFERRED EMBODIMENTS

Figure 1:
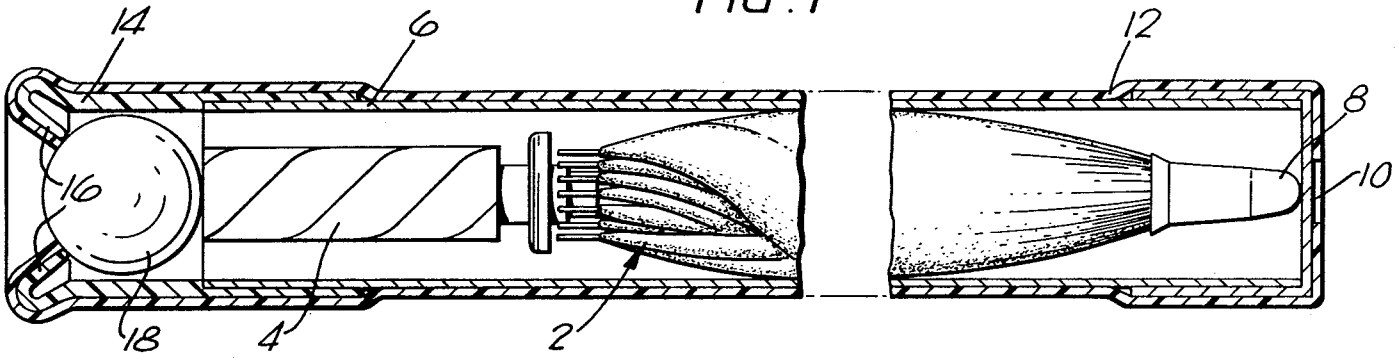
FIG. 1 is a longitudinal cross-section through a package according to a first embodiment of the invention.

In the drawings an umbrella generally indicated at 2 having a handle 4 is housed within an elongate tube 6. At one end of the tube as shown, the tip 8 of the umbrella 2 abuts against an end cap 10 which closes the respective end of the tube. The entire tube is enveloped in a sleeve 12 which is shrunk fit around the tube 6 and its ends.

In the embodiment of FIG. 1 the golf ball pick-up device is a functional part of the package. As can be seen, it comprises a cylindrical element 14 mounted at the end of the tube 6 and at its outer end comprises a lip 16 which extends radially inward to a diameter less than that of the tube 6. As shown, a golf ball 18 is retained behind the lip and abuts against the umbrella handle to hold the umbrella within the tube. The sleeve 12 extends around the lip 16 to prevent inadvertent distortion of the lip permitting the golf ball 18 to be released from the tube.

In the embodiment of FIG. 1 additional end pieces may if desired be used to provide more secure closure at the end of the tube 6. Such end pieces would be held in place of course, by the sleeve 12.

Figure 2:
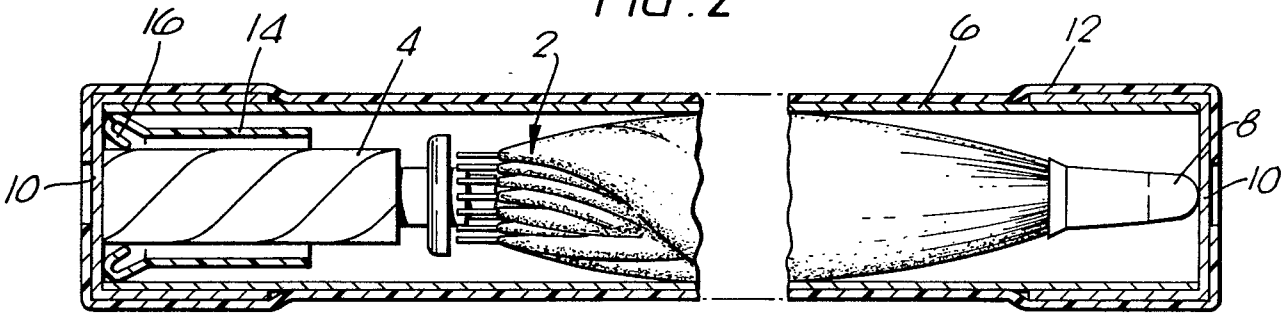
FIG. 2 is a longitudinal cross-section through a package according to a second embodiment of the invention.

In the embodiment of FIG. 2, each end of the tube 6 is closed by an end cap 10. In this case, the golf ball pick-up device is compressed and contracted, and housed within the tube around the umbrella handle 4. In this embodiment, the tube can of course be a little shorter, and the contracted device serves to some extent as a packing preventing rattling of the umbrella handle 4 in the tube. The end caps used in this embodiment will normally be substantially rigid as their primary purpose is for protection of the umbrella and the ends of the tube while the package is in transit.

When a package according to either embodiment illustrated is received by a customer, the sleeve 12 can be removed and discarded. The or each end cap 10 can be removed, and the umbrella 2 withdrawn. The tube of the FIG. 1 embodiment is then ready for immediate use as a golf ball pick-up tube, the pick-up device 14 being forced over a ball on the ground until it passes the lip 16, and then carried to other balls to repeat the process with each until the tube is filled. The tube of FIG. 1 must first be fitted with the device 14 from within the tube before the pick-up tube is ready.

I claim:

1. An umbrella package comprising:

a tube;

a cap closing one end of said tube;

a golf ball pick-up device at the other end of said tube such device comprising a cylindrical element extending coaxially from the tube with an annular resilient lip extending inwardly to a radius less than that of the tube, wherein the umbrella in collapsed form is housed within the tube; and an opaque removable sleeve covering said tube.

2. A package comprising a transparent tube in which is confined a collapsed umbrella, each end of the tube being closed by a removable cap; a golf ball pick-up device formed of a molded resilient material, said device being compressed around an end of the umbrella and confined therewith in the tube, the package being adapted for conversion to a golf ball pick-up tube by removal of one end cap, the pick-up device, and the umbrella from one end of the tube and by fitting the pick-up device to said one end.

3. A combination of non-metallic umbrella and transparent plastic golf ball pick-up tube, said golf ball pick-up tube having a cap closing one end a golf ball pick-up device molded in a rubber compound at the other end, which device comprises a cylindrical element extending co-axially from the tube with an annular resilient lip extending inwardly to a radius less than that of the tube, wherein the umbrella in collapsed form is housed within the golf ball pick-up tube and wherein the golf ball pick-up tube and umbrella are covered by an opaque removable sleeve, said sleeve co-operating with a removable end piece to retain the umbrella in the golf ball pick up tube.

4. A package comprising a transparent tube of which one end is closed by a removable cap and the other end has attached thereto a golf ball pick-up device in the form of a cylindrical element extending co-axially from tube with an annular resilient lip extending inwardly to a radius less than that of the tube; a collapsed umbrella confined in the tube; and a golf ball behind said lip thereby closing said other end of the tube to confine the umbrella therein.

5. A package according to claim 2 or claim 4 including a removable sleeve enveloping the tube and end caps.

6. A package according to claim 5 wherein said sleeve is opaque.

7. A package according to claim 2 on claim 4 wherein said umbrella is made substantially of non-metallic materials.

8. The combination of an umbrella and golf ball pick-up tube, the tube having a cap closing one end and a ball pick-up device at the other end which device comprises a cylindrical element extending co-axially from the tube with an annular resilient lip extending inwardly to a radius less than that of the tube, wherein the umbrella in collapsed from is housed within the golf ball pick-up tube, and wherein the golf ball pick-up tube and umbrella are covered by a removable sleeve.

9. A combination according to claim 1 including a removable end piece co-operating with the sleeve to retain the umbrella in the tube.

10. A combination according to claim 1 or claim 9 wherein the pick-up device is confined within the tube and separately attachable to the respective end thereof.

11. A combination according to claim 1 wherein the removable sleeve is opaque.

12. A combination according to claim 1 wherein the sleeve is shrink fitted to the tube.

13. A combination according to claim 1 wherein the umbrella is made substantially from non-metallic materials.

14. A combination according to claim 1 including a golf ball within the pick-up device which prevents passage of the umbrella from the tube.

15. A combination according to claim 10 wherein the pick-up device is moulded in a rubber compound.

16. A combination according to claim 9 wherein the end piece is formed in a substantially rigid material

17. A combination according to claim 8 wherein the tube is formed in a transparent plastics material.

* * * * *